US005375317A

United States Patent [19]

Murakami et al.

[11] Patent Number: 5,375,317

[45] Date of Patent: Dec. 27, 1994

[54] TERMINAL CRIMPING APPARATUS WITH TERMINAL ATTITUDE CORRECTING UNIT

[75] Inventors: Yukio Murakami; Shigeharu Suzuki, both of Yokkaichi, Japan

[73] Assignee: Sumitomo Wiring Systems, Ltd., Japan

[21] Appl. No.: 150,718

[22] Filed: Nov. 12, 1993

[30] Foreign Application Priority Data

Dec. 1, 1992 [JP] Japan ..... 4-89515[U]

[51] Int. Cl.[5] ..... H01R 43/055

[52] U.S. Cl. ..... 29/753; 29/760; 29/863

[58] Field of Search ..... 29/33 M, 748, 751, 753, 29/759, 760, 857, 863, 874, 882, 884

[56] References Cited

U.S. PATENT DOCUMENTS

| | | | |
|---|---|---|---|
| 4,707,913 | 11/1987 | Moline | 29/753 |
| 4,815,200 | 3/1989 | Ito | 29/857 |
| 4,970,778 | 11/1990 | den Otter | 29/760 X |
| 4,979,291 | 12/1990 | Phillips et al. | 29/863 |
| 5,018,270 | 5/1991 | Caumanns | 29/863 |

FOREIGN PATENT DOCUMENTS

| | | | |
|---|---|---|---|
| 375458 | 6/1990 | European Pat. Off. | 29/753 |
| 2643514 | 8/1990 | France | 29/748 |
| 2842342 | 8/1979 | Germany | 29/760 |
| 12097 | 2/1978 | Japan | 29/863 |
| 189883 | 7/1989 | Japan | 29/753 |
| 244581 | 9/1990 | Japan | 29/753 |
| 147287 | 6/1991 | Japan | 29/753 |
| 152891 | 6/1991 | Japan | 29/753 |

*Primary Examiner*—Peter Dungba Vo
*Attorney, Agent, or Firm*—Jordan B. Bierman

[57] ABSTRACT

There is disclosed a terminal crimping apparatus which comprises a crimping machine (29) for connecting a cable connection portion (2a) of crimp terminals (2) to a cable end by crimping the cable connection portion (2a), a terminal frame supply mechanism (30) for intermittently supplying the crimp terminals (2) in the form of a terminal frame (4) to the crimping machine (29), and a terminal attitude correcting unit (36) for the crimp terminals provided on the way of a supply path of the terminal frame to the crimping machine (29). The terminal frame supply mechanism (30) includes a terminal guide jig (35) having guide grooves (34) for guiding carriers (1) of the terminal frame (4), and the terminal attitude correcting unit (36) is provided on the way of the guide path of the terminal frame (4) by means of the terminal guide jig (35). The terminal attitude correcting unit (36) includes an attitude correcting jig (38) having a groove (37) releasably receiving the cable connection portion (2a) of the crimp terminals (2). The attitude correcting jig (38) is extended and retracted by an air cylinder (39) between an attitude correction position in the supply path in which the cable connection portion (2a) is fitted in the groove (37) and the attitude of the cable connection portion (2a) is corrected to a predetermined direction and a retracted position deviated from the supply path. The terminal crimping apparatus is therefore prevented from crimp-connecting defects of the crimp terminals (2).

5 Claims, 5 Drawing Sheets

TERMINAL CRIMPING APPARATUS WITH TERMINAL ATTITUDE CORRECTING UNIT

BACKGROUND OF THE INVENTION

1. Field of the Invention

The present invention relates to a terminal crimping apparatus for serially fixedly pressure-connecting, to cables, crimp terminals supplied in the form of terminal frame.

2. Description of the Prior Art

An example of terminal frames includes a terminal frame 4 shown in FIG. 5 which comprises carriers 1 on opposite sides and crimp terminals 2 connected between the carriers 1 via link portions 3 and constantly spaced apart from each other in succession along the length of the carriers 1.

Each crimp terminal 2 includes a cable connection portion 2*a* to be crimped and connected to a high-voltage resistant cable or the like and a terminal connection portion 2*b* to be connected to an electrical equipment or the like.

As shown in FIG. 6, the carriers 1 of the terminal frame 4 are each fitted in a guide groove 8 of a terminal guide jig 7 of a terminal frame 4 supply mechanism 6 so that the crimp terminals 2 arc intermittently supplied one after another to a terminal crimping machine 9 along a guide path in a predetermined direction P.

The terminal crimping machine 9 includes an upper die 10 and a lower die 11 which are in general vertically opposed to each other. When an end of a stripped high-voltage resistant cable 12 is fitted into the cable connection portion 2*a* of a crimp terminal 2 supplied to a crimp-connecting position from the terminal frame supply mechanism 6, the upper die 10 is lowered. Then, the upper die 10 and the lower die 11 cooperatively connect the cable connection portion 2*a* to the end of the high-voltage resistant cable 12 by crimping the cable connection portion 2*a*, and cut the link portions 3.

However, the crimp-connecting will not be performed as it is desired and a number of crimp-connecting defects will be created, if the crimp terminal 2 is supplied from the terminal frame supply mechanism 6, with the attitude of the cable connection portion 2*a* of the crimp terminal 2 opened in a generally U-shape being inclined or with a center line M of the crimp terminal 2 being largely inclined from a reference line L extending in the direction of crimping of the upper die 10 and lower die 11 or in the vertical direction, as shown in FIG. 6 because of tangled crimp terminals 2 of the terminal frame 4 which is previously wound on a reel or the like or any other reason.

SUMMARY OF THE INVENTION

The present invention is directed to a terminal crimping apparatus receiving a terminal frame including constantly spaced crimp terminals each having a cable connection portion and a pair of carriers parallel to each other connected to opposite ends of the crimp terminals for serially connecting the crimp terminals to cables by crimping the crimp terminals. According to the present invention, the terminal crimping apparatus comprises: a crimping machine for connecting the cable connection portion of the crimp terminals to an end of the cables in a first predetermined position by crimping the cable connection portion; a terminal frame supply mechanism for intermittently supplying the crimp terminals of the terminal frame to the crimping machine so that the crimp terminals of the terminal frame are serially supplied to the first predetermined position; and a terminal attitude correcting unit provided in a second predetermined position located on the way of a supply path of the terminal frame to the crimping machine, the terminal attitude correcting unit including an attitude correcting jig having a groove releasably receiving the cable connection portion of the terminal, and driving means for extending and retracting the attitude correcting jig between an attitude correction position, located in the supply path, in which the attitude of the cable connection portion is corrected to a predetermined direction by fitting the cable connection portion in the groove and a retracted position deviated from the supply path.

According to the present invention, the attitude correcting jig is projected into the attitude correction position on the way of the supply path of the terminal frame to the crimping machine. The cable connection portion of the crimp terminal is fitted in the groove of the attitude correcting jig, so that the attitude of the cable connection portion is corrected to the predetermined direction.

Then the attitude correcting jig is retracted to the retracted position, and the cable connection portion of the crimp terminal is removed from the groove and is supplied toward the terminal crimping machine along the guide path.

The crimp terminal is supplied to the crimping machine, with the attitude thereof corrected to the predetermined direction, preventing crimp-connecting defects efficiently.

Accordingly, it is an object of the present invention to provide a terminal crimping apparatus which prevents crimp-connecting defects.

These and other objects, features, aspects and advantages of the present invention will become more apparent from the following detailed description of the present invention when taken in conjunction with the accompanying drawings.

DESCRIPTION OF THE PREFERRED EMBODIMENTS

Figure 4:
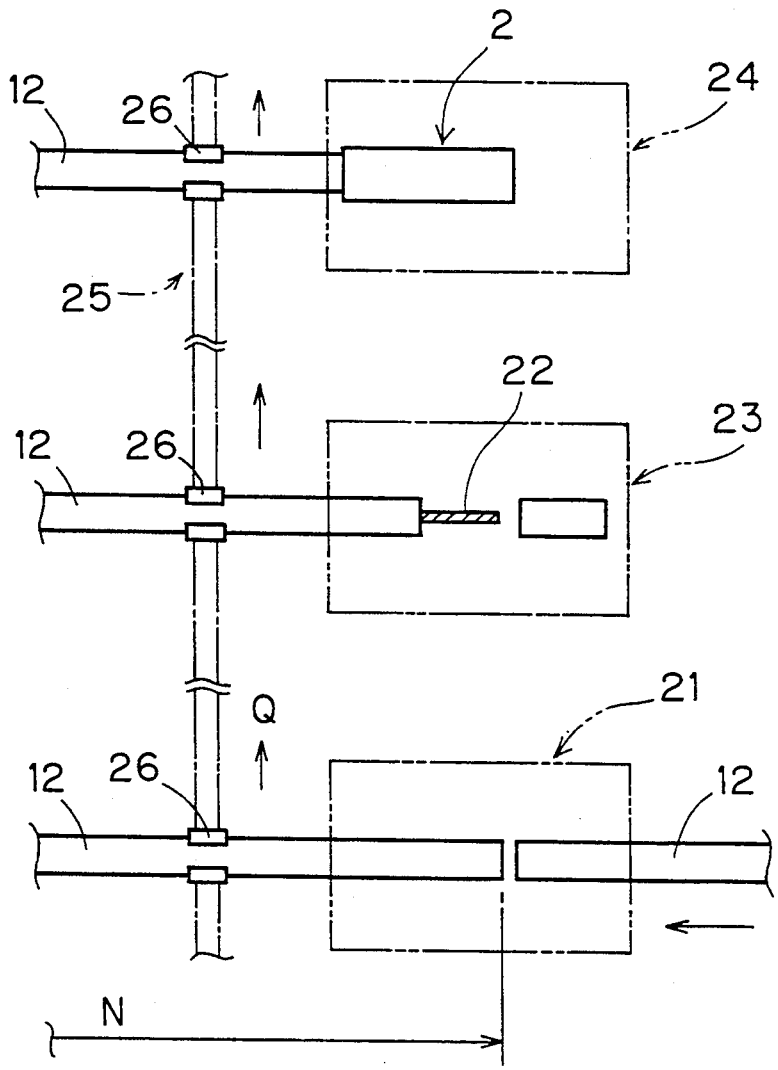
FIG. 4 schematically illustrates a processing system for connecting a crimp terminal to a high-voltage resistant cable.
Figure 5:
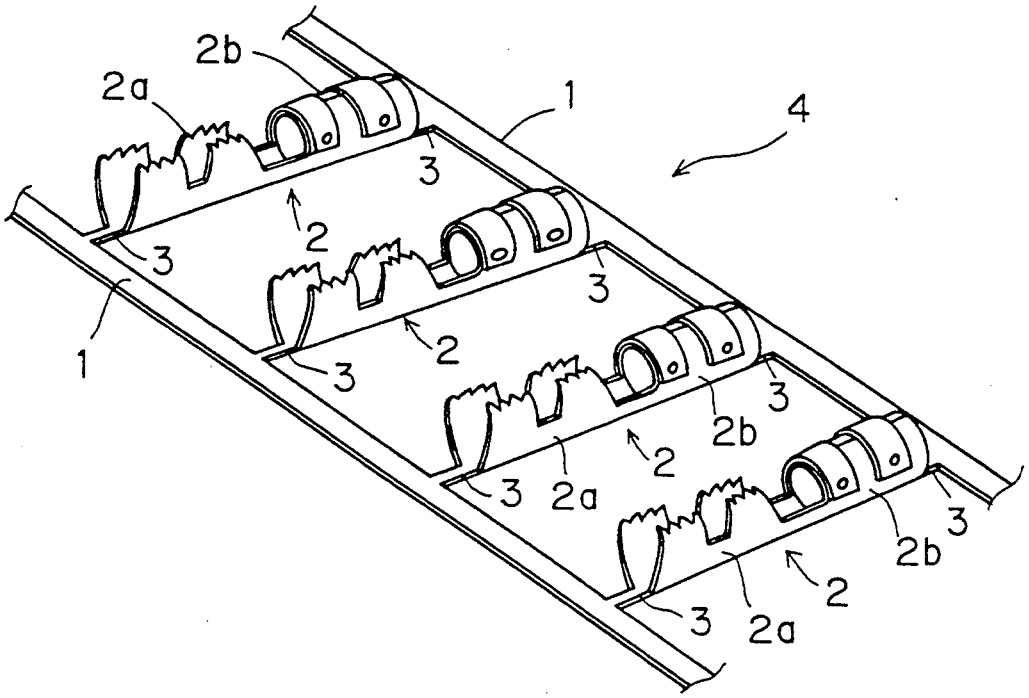
FIG. 5 PRIOR ART
FIG. 5 is a fragmentary perspective view of a terminal frame.
Figure 6:
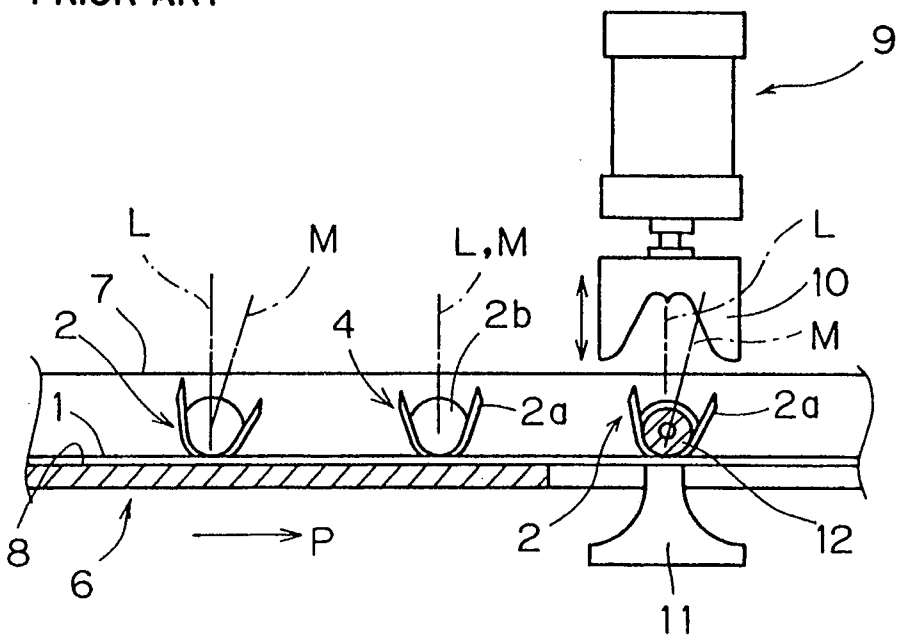
FIG. 6 PRIOR ART
FIG. 6 illustrates a major part of the prior art.

A preferred embodiment of the present invention will be described hereinafter with reference to the drawings. FIG. 4 schematically illustrates a processing system for high-voltage resistant cables 12 for an automotive vehicle. The processing system comprises a cable cutting station 21 for cutting the high-voltage resistant cable 12 serially supplied from a reeling drum or the like to a predetermined length N, a stripping station 23 for stripping sheath off an end of the high-voltage resistant cable 12 to expose a core portion 22 of a predetermined length, and a terminal crimping station 24 for connecting a crimp terminal 2 to the stripped end of the high-voltage resistant cable 12 by crimping the crimp terminal.

Referring to FIG. 4, reference numeral 25 designates a transport conveyor including chains and belts which is endless and capable of intermittently revolving in cycles. A multiplicity of pairs of openable and closable transport clamps 26 spaced along the length of the transport conveyor 25 are mounted on the transport conveyor 25.

The high-voltage resistant cable 12 which is cut to the length N in the cable cutting station 21 is clamped on its opposite sides by the transport clamps 26 and is in turn serially transported to the stripping station 23 and then to the terminal crimping station 24 by the revolution of the transport conveyor 25 in a predetermined direction Q.

Figure 1:
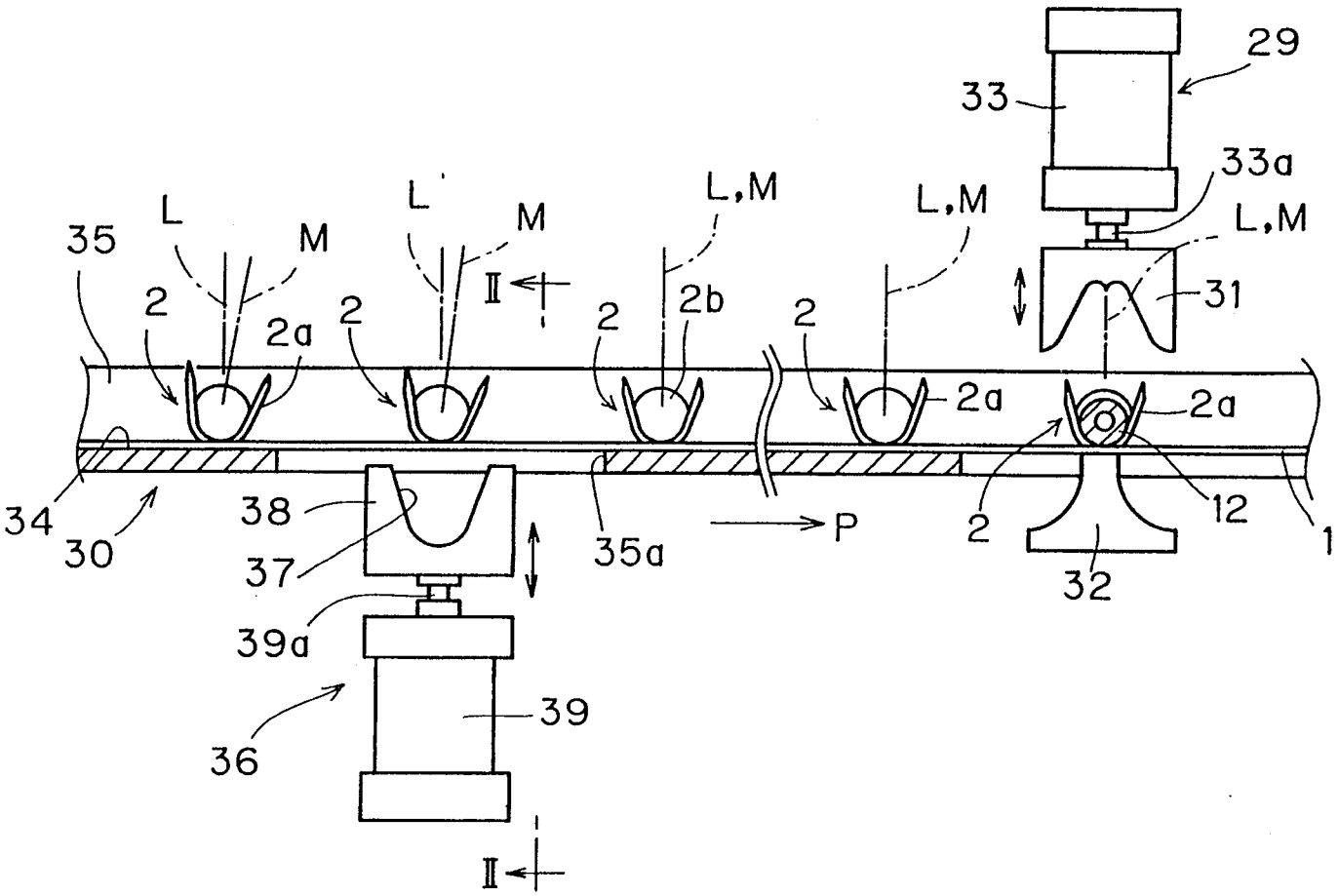
FIG. 1 illustrates a major part of a preferred embodiment of the present invention.
Figure 2:
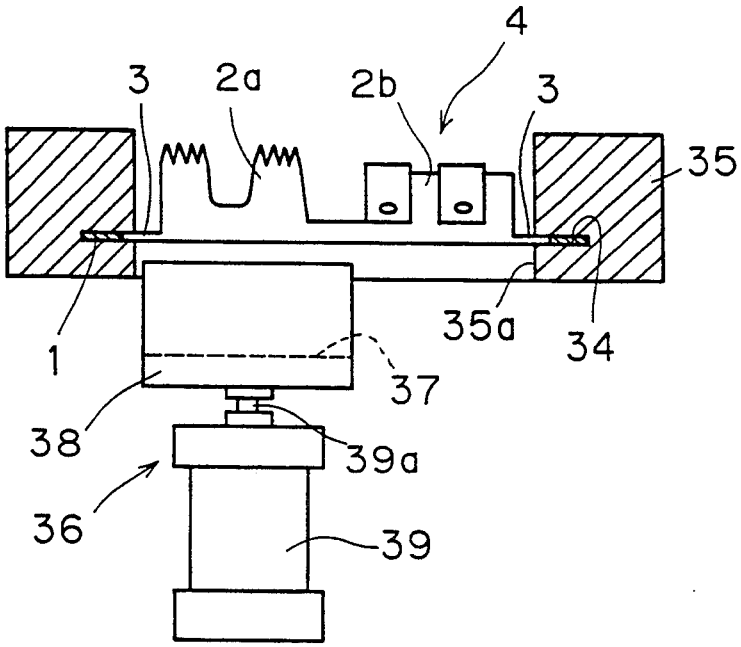
FIG. 2 is a cross-sectional view taken along the line II—II of FIG. 1.

In the terminal crimping station 24, there is provided a terminal crimping apparatus, as shown in FIGS. 1 and 2, which comprises a crimping machine 29 located in a first predetermined position, a terminal attitude correcting unit 36 located in a second predetermined position, and a terminal frame supply mechanism 30 for serially supplying the crimp terminals 2 of the terminal frame 4 to the crimping machine 29 through the terminal attitude correcting unit 36. The crimping machine 29 includes an upper die 31 and a lower die 32 opposed vertically in the first predetermined position, the upper die 31 being permitted to move vertically up and down by a lift such as an air cylinder 33. A cylinder piston **33*a* of the air cylinder 33** is adapted to extend and retract without rotation.

The terminal frame supply mechanism 30 is provided with a terminal guide jig 35 in the horizontal attitude which has guide grooves 34 receiving carriers 1 on opposite sides of the terminal frame 4, respectively, for guiding the terminal frame 4 in a predetermined direction P. The terminal attitude correcting unit 36 for correcting the attitude of a cable connection portion **2*a* of the crimp terminal 2 is provided in the second predetermined position located on the way of the supply path of the terminal frame 4 along the terminal guide jig 35**.

Figure 3:
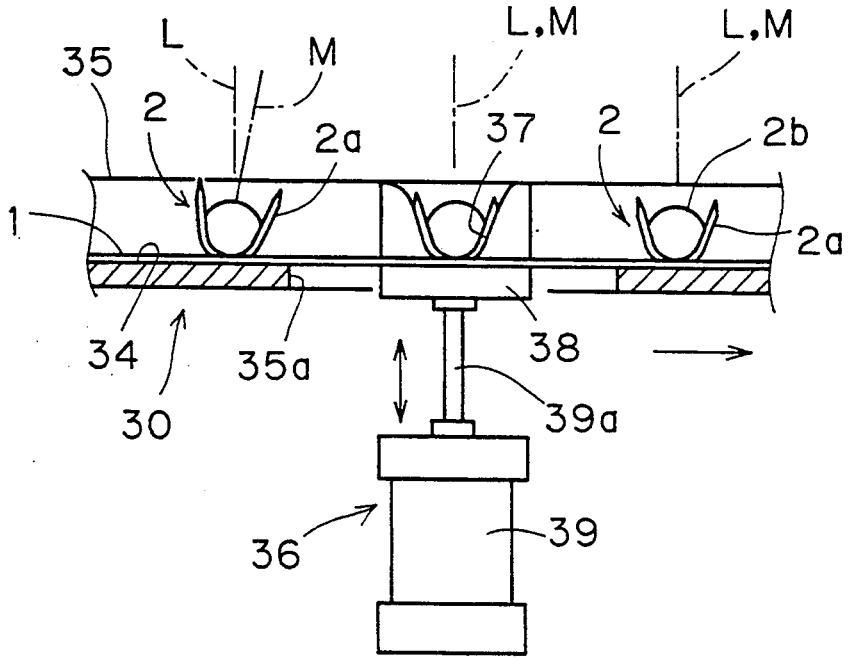
FIG. 3 illustrates the operation of a terminal attitude correcting unit.

The terminal attitude correcting unit 36 includes an attitude correcting jig 38 having a groove 37 of a shape which conforms to the shape of the cable connection portion **2*a* so as to releasably receive the cable connection portion 2*a* of the crimp terminal 2, and a driving means such as an air cylinder 39 for extending and retracting the attitude correcting jig 39. As shown in FIGS. 1 to 3, the attitude correcting jig 38 is projected upwardly into the supply path of the crimp terminal 2 through an opening 35*a* formed in the terminal guide jig 35 by means of the air cylinder 39, with the groove 37 assuming an upside facing attitude. The attitude correction jig 38 is adapted to freely extend and retract between an attitude correction position in which the cable connection portion 2*a* is fitted in the groove 37 and a retracted position in which the attitude correcting jig 38 is retracted downwardly out of the supply path. A cylinder piston 39*a* of the air cylinder 39** is adapted to extend and retract without rotation.

The terminal frame supply mechanism 30 is provided with an intermittent supply mechanism not shown for intermittently supplying the terminal frame 4 to the crimping machine 29 along the terminal guide jig 35.

The intermittent supply mechanism serially supplies the terminal frame 4 in intermittent fashion to the terminal guide jig 35 from the winding reel or the like until the crimp terminal 2 of the terminal frame 4 is brought to a stop when it comes to a position corresponding to the attitude correcting jig 38 of the attitude correcting unit 36.

As the crimp terminal 2 stops at the position corresponding to the attitude correcting jig 38, the air cylinder 39 is actuated to cause the attitude correcting jig 38 to move to the attitude correction position, so that the cable connection portion **2*a* of the crimp terminal 2 is fitted into the groove 37 of the attitude correcting jig 38. The fitting of the cable connection portion 2*a* into the groove 37 permits the attitude of the cable connection portion 2*a* of the crimp terminal 2 opened in a generally U-shape to be corrected, or permits the center line M thereof to be corrected to such a normal direction as to generally coincide with a reference line L extending in the direction of crimping of the upper die 31 and lower die 32**, i.e., in the vertical direction.

Each crimp terminal 2 is intermittently supplied one after another to the crimping machine 29 by the intermittent supply mechanism. As the crimp terminal 2 reaches the crimping position of the crimping machine 29 and stops, the end of the high-voltage resistant cable 12 stripped in the stripping station 23 is fitted in the cable connection portion **2*a* of the crimp terminal 2**.

After the end of the high-voltage resistant cable 12 is fitted in the cable connection portion **2*a*, the air cylinder 33 is actuated to cause the upper die 31 to lower. Then the upper die 31 and lower die 32 cooperatively connect the cable connection portion 2*a* to the end of the high-voltage resistant cable 12 by crimping the cable connection portion 2*a* and cut link portions 3 of the terminal frame 4**.

In the preferred embodiment of the present invention, if the terminal frame 4 is serially supplied to the crimping machine 29 along the guide groove 34 of the terminal guide jig 35 with the center line M of the cable connection portion **2*a* of the crimp terminal 2 being largely inclined from the reference line L resulting in an abnormal supply attitude due to tangled crimp terminals 2, the extension and retraction of the attitude correcting jig 38 of the terminal attitude correcting unit 36 permits the attitude of the cable connection portion 2*a* to be corrected to the normal direction on the way of the supply path of the terminal frame 4 by means of the terminal guide jig 35. Thus the attitude of the crimp terminal 2 supplied to the crimping position of the crimping machine 29 is such that the center line M thereof generally coincides with the reference line L, thereby providing good crimp-connecting by using the upper die 31 and lower die 32 of the crimping machine 29**, also preventing crimp-connecting defects efficiently.

Although the groove 37 of the attitude correcting jig 38 is of a shape corresponding to that of the cable connection portion **2*a* of the crimp terminal 2 in the foregoing preferred embodiment, the groove 37 may be shaped to receive the whole crimp terminal 2 including the terminal connection portion 2*b* as well as the cable connection portion 2*a***.

While the invention has been shown and described in detail, the foregoing description is in all aspects illustrative and not restrictive. It is therefore understood that numerous modifications and variations can be devised without departing from the scope of the invention.

What is claimed is:

1. A terminal crimping apparatus receiving a terminal frame including constantly spaced crimp terminals each having a cable connection portion and a pair of carriers parallel to each other connected to opposite ends of said crimp terminals for serially connecting said crimp terminals to cables by crimping the crimp terminals, said terminal crimping apparatus comprising:

a crimping machine for connecting said cable connection portion of said crimp terminals to an end of said cables in a first predetermined position by crimping said cable connection portion;

a terminal frame supply mechanism for intermittently supplying said crimp terminals of said terminal frame to said crimping machine so that said crimp terminals of said terminal frame are serially supplied to said first predetermined position; and a terminal attitude correcting unit for said crimp terminals provided in a second predetermined position located on the way of a supply path of said terminal frame to said crimping machine, said terminal attitude correcting unit including an attitude correcting jig having a groove releasably receiving said cable connection portion of said terminal, and driving means for extending and retracting said attitude correcting jig between an attitude correction position, located in said supply path, in which the attitude of said cable connection portion is corrected to a predetermined direction by fitting said cable connection portion in said groove and a retracted position deviated from said supply path.

2. The terminal crimping apparatus of claim 1, wherein said crimping machine includes an upper die and a lower die provided in vertically opposed relation, and a lift for moving up and down said upper die.

3. The terminal crimping apparatus of claim 1, wherein said terminal frame supply mechanism includes a terminal guide jig having guide grooves receiving said carriers of said terminal frame, respectively, for guiding said terminal frame in a predetermined direction.

4. The terminal crimping apparatus of claim 3, wherein said terminal guide jig has an opening through which said attitude correcting jig extends and retracts.

5. The terminal crimping apparatus of claim 1, wherein each of said crimp terminals includes a terminal connection portion, and said groove of said attitude correcting jig is shaped to receive said cable connection portion and said terminal connection portion of said crimp terminals.

* * * * *